US006947034B2

(12) United States Patent
Kwon

(10) Patent No.: US 6,947,034 B2
(45) Date of Patent: Sep. 20, 2005

(54) IMPULSE DRIVING METHOD AND APPARATUS FOR LCD

(75) Inventor: Su-Hyun Kwon, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 130 days.

(21) Appl. No.: 09/956,316

(22) Filed: Sep. 19, 2001

(65) Prior Publication Data

US 2002/0109654 A1 Aug. 15, 2002

(30) Foreign Application Priority Data

Feb. 14, 2001 (KR) ..... 2001-7243

(51) Int. Cl.[7] ..... G09G 5/00
(52) U.S. Cl. ..... 345/204; 345/214
(58) Field of Search ..... 345/72, 78, 79, 345/80, 83, 84, 87, 88, 90, 92, 98, 99, 204, 214, 209, 100, 96, 89, 127

(56) References Cited

U.S. PATENT DOCUMENTS 5,572,211 A * 11/1996 Erhart et al. ..... 341/144
5,818,416 A * 10/1998 Hwang ..... 345/667
6,054,974 A * 4/2000 Sakai et al. ..... 345/98
6,344,850 B1 * 2/2002 Okumura et al. ..... 345/204
6,392,620 B1 * 5/2002 Mizutani et al. ..... 345/88
6,473,077 B1 * 10/2002 Takenaka et al. ..... 345/209
6,567,097 B1 * 5/2003 Iwaki ..... 345/603
6,577,322 B1 * 6/2003 Fukuda ..... 345/698
6,633,283 B2 * 10/2003 Fukuda et al. ..... 345/204
2002/0044117 A1 * 4/2002 Matsumura et al. ..... 345/87

FOREIGN PATENT DOCUMENTS

JP 10-240195 * 2/1997
JP 410240195 A * 2/1997
JP 10-240195 * 11/1998
JP 2003249092 * 9/2003

* cited by examiner

*Primary Examiner*—Vijay Shankar
*Assistant Examiner*—Nitin Patel
(74) *Attorney, Agent, or Firm*—F. Chau & Associates, LLC

(57) ABSTRACT

There is provided an impulse driven LCD which comprises: an LCD drive controller for outputting normal data, adjust data for impulse generation, and a first control signal for controlling the output of the normal or adjust data, and for outputting a second control signal for controlling display of an image signal according to the normal or adjust data; the LCD drive controller includes a scan driver for sequentially outputting first and second scan signals for a 1H period according to application of the second control signal; and an LCD panel for charging the normal data signal to a storage capacitor according to application of the first scan signal, and for charging the adjust data signal to the storage capacitor according to application of the second scan signal.

10 Claims, 6 Drawing Sheets

IMPULSE DRIVING METHOD AND APPARATUS FOR LCD

BACKGROUND OF THE INVENTION

1. Field of the Invention

The present invention relates to a liquid crystal display and a driving apparatus thereof, and specifically, to an impulse driven liquid crystal display and a driving apparatus thereof for realizing moving images.

2. Description of the Related Art

Generally, a liquid crystal display (LCD) displays images by utilizing two sheets of polarizing material with a liquid crystal layer disposed between them. An electric current passed through the liquid crystals causes the crystals to align so that light cannot pass through them. Each crystal is like a shutter, either allowing light to pass through or blocking the light. An LCD controls the luminance of the display by controlling the intensity of the light generated from the LCD, while a conventional cathode ray tube (CRT) display controls the luminance by controlling the intensity of the scanned electronic beam.

With advances in imaging technology, demand for superior displays of moving images in addition to stationary images has increased.

One problem with displaying moving images on LCDs is image dragging. This problem occurs when the response speed of liquid crystals is slower than one frame period, and image dragging results from voltages charged on one frame not being dissipated when a new voltage is applied at the next frame.

FIG. 1*a* is a graphical representation of wave forms for showing the relation of light density versus time of a conventional CRT, and FIG. 1*b* is a graphical representation of wave forms for showing the relation of light density versus time of a conventional LCD.

As shown by the spiked waveforms in FIG. 1*a*, the CRT is impulse driven, and the LCD is hold or level driven, as shown by the plateau wave forms in FIG. 1*b*. The level drive causes the image-dragging phenomenon.

One solution to remove the dragging phenomenon on the display of a LCD is by impulse driving the LCD, by inputting data for a time period less than one frame, and inputting black or white data for the remaining time of the frame.

As an example, impulse drive to an LCD can be accomplished by changing the driving frequency from 60 Hz to 120 Hz or 180 Hz. In such instances, a normal data is input to one frame (60 Hz) while black or white data is input to another frame (in the case of 120 Hz) or to two frames (in the case of 180 Hz). To implement such impulse driving, it is necessary to store one or two frames of data in a frame memory.

Since frame memories are costly, it is desirable to have a method or apparatus for impulse driving LCDs without use of frame memories.

SUMMARY OF THE INVENTION

The present invention is directed to provide a liquid crystal display to solve the above-mentioned problems and disadvantages.

Another object of the present invention is to provide a liquid crystal display (LCD) of an impulse driving type that easily controls data blocking using a lower-priced line memory rather than a higher-priced frame memory.

A further object of the present invention is to provide an impulse driving apparatus for the liquid crystal display.

According to an aspect of the present invention, a liquid crystal display (LCD) drive apparatus is provided, comprising an LCD drive controller for outputting normal data, adjust data and control signals for control signals controlling display of an image by the LCD signal according to the normal and adjust data, the control signals including a first scan signal and a second scan signal and a liquid crystal display panel including a liquid crystal capacitor to be charged by the normal data according to application of the first scan signal, and to be charged by the adjust data according to application of the second scan signal, wherein the normal data represents image data received by the LCD drive controller and adjust data represents offset data to offset the charge to the liquid crystal capacitor by the normal data.

Preferably, the adjust data is either black data or white data. The control signals include a first control signal having a start horizontal signal for controlling storage of the normal data or adjust data, and a load signal for outputting the stored normal or adjust data, and a second control signal having a gate clock signal for controlling generation of a gate-on signal, a start vertical signal for controlling starting of the gate-on signal, and an output enable signal for controlling charging of the liquid crystal capacitor by the normal or adjust data.

According to one preferred embodiment, the LCD drive controller sequentially supplies a gate-on signal to each of n gate lines aligned on the liquid crystal display panel for a 1 H period, and sequentially supply the gate-on signal to the first gate line when the gate-on signal is applied to the n/k (k is an integer of two or more) gate lines for switch-on. Preferably, the LCD drive controller includes a line memory for storing normal data, and the line memory comprises a first line memory for recording data, and a second line memory for outputting data. In this embodiment, an image data charge period is 1 H, the normal data charge period is about one half of 1 H and the adjust data charge period is about one half of 1 H.

In another aspect of the present invention, an apparatus for driving an impulse driven liquid crystal display comprises a liquid crystal display comprising a plurality of gate lines for transmitting a scan signal, a plurality of data lines for transmitting an image signal, a switch connected to the gate lines and the data lines, and a liquid crystal capacitor connected to one end of the switch; a timing controller for outputting a normal data for normal driving, adjust data for impulse generation, and a first control signal for controlling the output of the normal or adjust data for a 1 H period, and for outputting a second control signal for a 1 H period for controlling display of an image signal according to the normal or adjust data; a data driver for converting the normal data or the adjust data according to application of the first control signal and for outputting the normal data signal or adjust data signal to the data lines; and a scan driver for sequentially outputting a first scan signal and a second scan signal to the gate lines for a 1 H period according to application of the second control signal.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, preferred embodiments of the invention have been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1A:
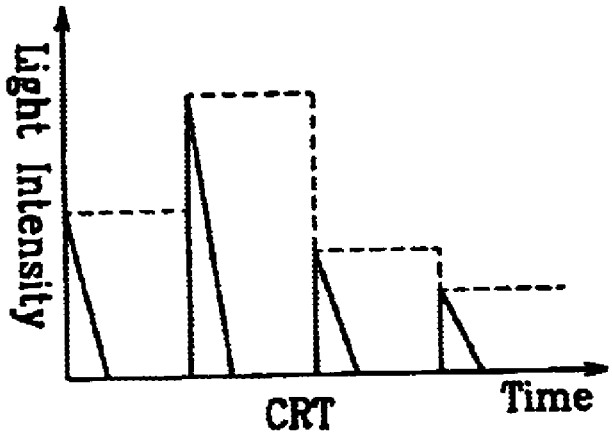
FIGS. 1*a* and 1*b* are graphical representation of waveforms for explaining the relations of light density to time of a conventional CRT and a conventional LCD.
Figure 1B:
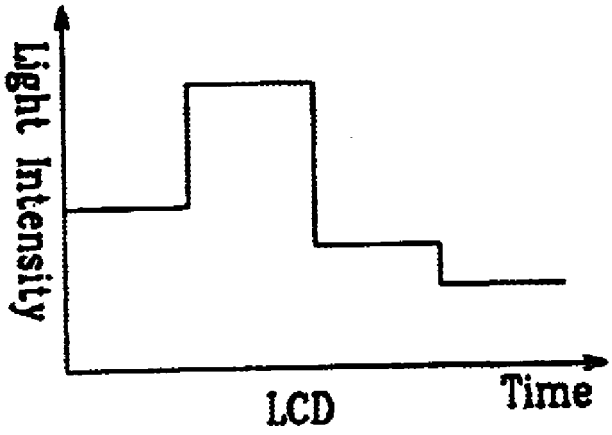
Figure 2:
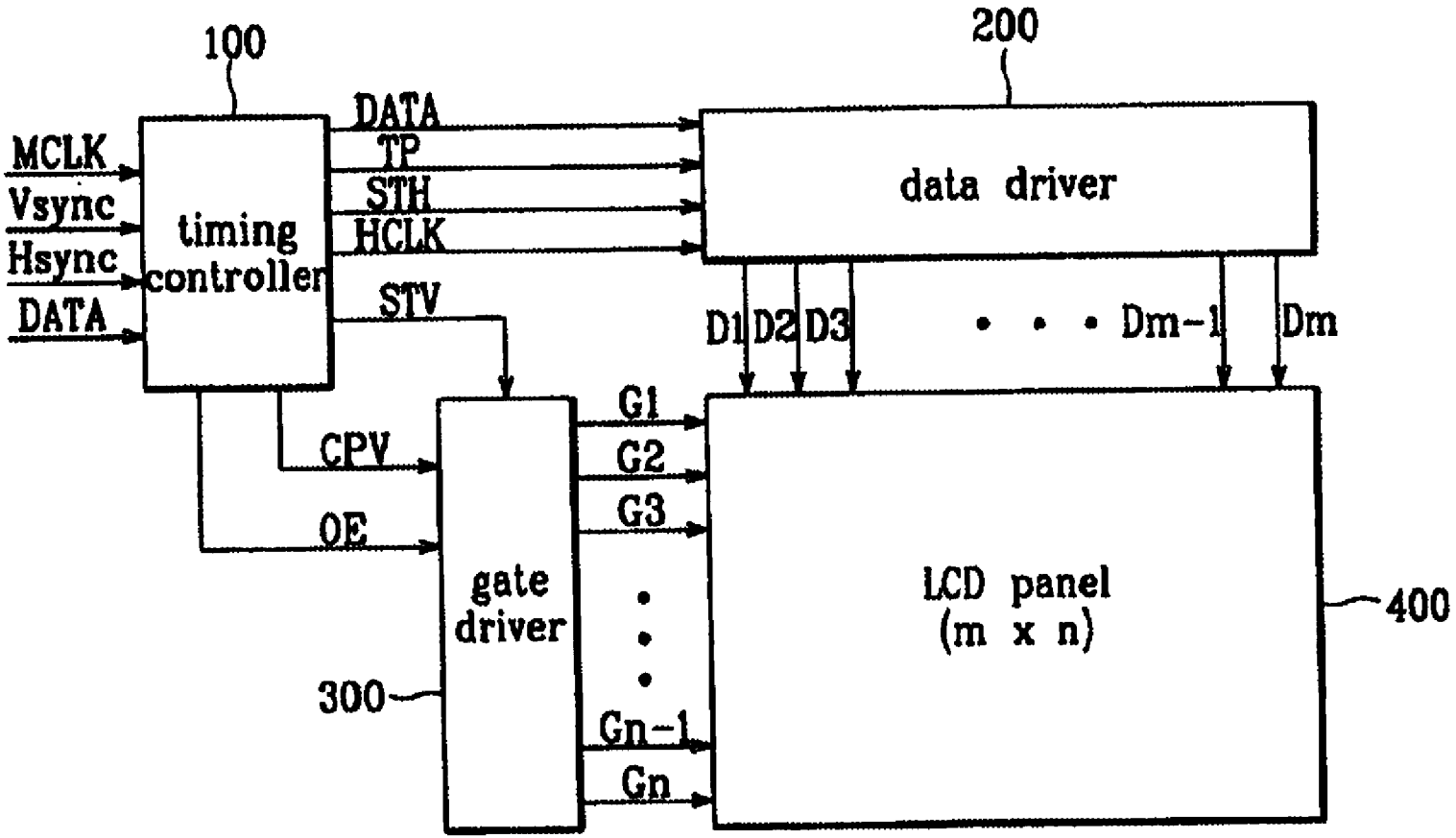
FIG. 2 is a block diagram of an LCD drive controller and an LCD panel according to a preferred embodiment of the present invention.
Figure 3:
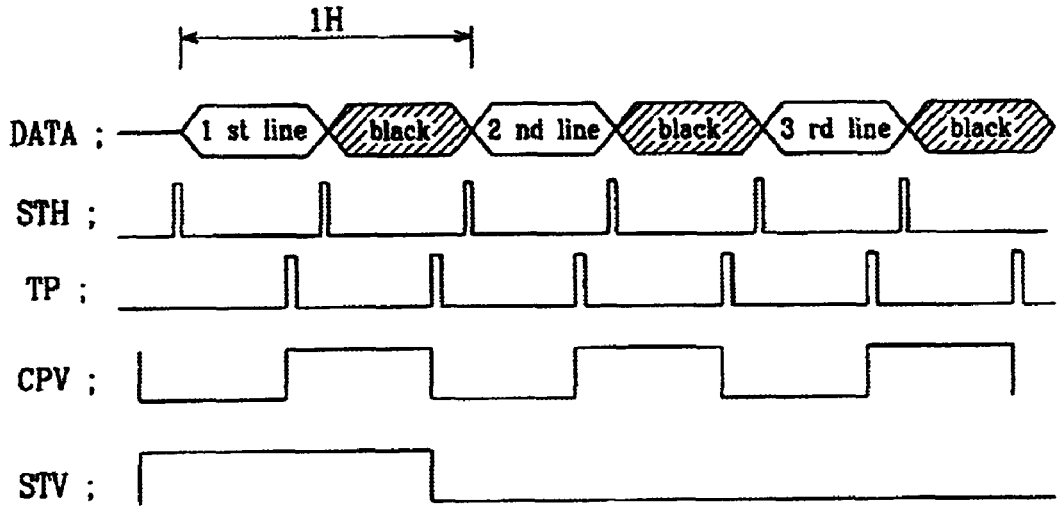
FIG. 3 shows output wave forms of signals of FIG. 2.

FIG. 2 is a schematic representation of an impulse driven liquid crystal display (LCD) according to a preferred embodiment of the present invention, and FIG. 3 is a graphical representation showing wave forms to explain the signals of FIG. 2.

Referring to FIG. 2, the LCD comprises LCD drive controller which includes a timing controller 100, a data driver 200 having a plurality of drive circuits, and a gate driver (or scan driver) 300 also having a plurality of drive circuits. The LCD includes a LCD panel 400. The timing controller 100, which comprises a line memory (not shown), receives image data input from an external graphic controller (not shown), and outputs the image data to data driver 200 via the DATA signal line. Control signals are sent to data driver 200 and gate driver 300 to control the charging of the liquid crystals in LCD panel 400. According to a preferred embodiment of the present invention, the image data received by the timing controller 100 is altered in time and presented to data driver 200 as normal data for normal driving and adjust data for generation of an impulse signal instead of a level signal within a 1 H period. A first control signal for controlling the output of the normal data and adjust data is generated by timing controller 100 and output to the data driver 200.

Referring to FIG. 3, the first control signal includes a start horizontal (STH) signal for controlling storage of normal data or adjust data in data driver 200. A TP (or load) signal is used to output the stored normal data or adjust data.

The adjust data input to the data driver 200 for a 1 H period can be black data or white data, depending on whether the liquid crystal mode is a normally black mode or a normally white mode. For example, if the liquid crystal mode is normally white, the normal data will be presented in white and the adjust data in black. Thus, either white data or black data can be used as adjust data to offset the charging of the normal data.

Even though it is not shown, one skilled in the art can readily appreciate that a line memory can be installed inside the timing controller 100 of the present invention and can be divided into a line memory area for storing the data input from a graphic controller, and a line memory area for outputting the stored data to the data driver.

The timing controller 100 outputs a second control signal for controlling display of image signals according to normal data or adjust data to the data driver 200 for a 1 H period. The second control signal, shown in FIG. 3, includes a gate clock signal (CPV) for selecting gate line, a start vertical (STV) signal for controlling starting of the gate-on signal and selecting the first gate line, and an output enable (OE) signal enabling gate driver 300 to output $G_1$ to $G_n$ for controlling charging of data at LCD panel 400.

The data driver 200 stores normal data or adjust data according to application of the first control signal, converts stored data to analog signals, and outputs normal data signals or adjust data signals to the LCD panel 400. According to the present embodiment, the data driver 200 stores normal data and adjust data according to application of the STH signal from the timing controller 100, and supplies stored normal data or adjust data to the data line ($D_1$ to $D_m$) of the LCD panel 400 according to application of the TP (LOAD) signal.

The gate driver 300 outputs a first scan signal and a second scan signal to the LCD panel 400 sequentially according to application of the second control signal. Preferably, the gate driver 300 sequentially outputs a gate-on signal ($G_1$ to $G_n$) to each gate line of the LCD panel 400 according to application of CPV, STV, or OE signals from the timing controller 100, and controls to store normal data or adjust data applied from the data driver 200 in corresponding liquid crystal capacitors of the LCD panel 400.

The LCD panel 400 comprises a plurality of data lines, a plurality of gate lines, TFTs connected to the data lines and the gate lines respectively, and a storage capacitor connected to one end of the TFT. Normal data signals charge the storage capacitor according to application of the first scan signal, and adjust data signals charge the storage capacitor according to application of the second scan signal.

The operation of an impulse driven LCD according to the present invention will now be described in view of an LCD panel.

If two or more different data signals, that is, data for normal driving, and adjust data in black or white are input through the data driver 200, the storage capacitor are charged with normal data starting from a first gate line according to a gate-on signal of the gate driver 300.

When a gate pulse is present, black or white data is shut off by an output enable (OE) signal. The black or white data is not image data and treated as adjust data so that only normal data is charged to the storage capacitor.

The operation of the charge is repeated from the first gate line, and when a gate-on pulse reached about the middle of the LCD panel 400, a second gate on-pulse is applied to the first gate line. At the time of the second gate on-pulse, normal data is shut off by an output enable (OE) signal, and black or white data is applied to the first gate line.

According to this embodiment of the invention, the 1 H period is divided into two during LCD panel driving, and normal data is sequentially charged from the first gate line, and when the charge reaches about the middle of the LCD panel, adjust data is sequentially charged from the first gate line.

According to another embodiment of the present invention, the 1 H period is divided by three during LCD panel driving, and normal data is sequentially charged from the first gate line, and when the charge reaches the point about one-third of the way from the front part of the LCD panel, the adjust data is sequentially charged from the first gate line.

According to the above described preferred embodiment of the present invention, black or white adjust data is input after 1 line of normal image data is input, and, if a gate terminal of a switch (TFT) on the LCD panel is opened, thereby inputting original data to the storage capacitor through a source terminal, and after charging, inputting a black or white data, an impulse driven liquid crystal display appropriate for moving images is realized.

Figure 4:
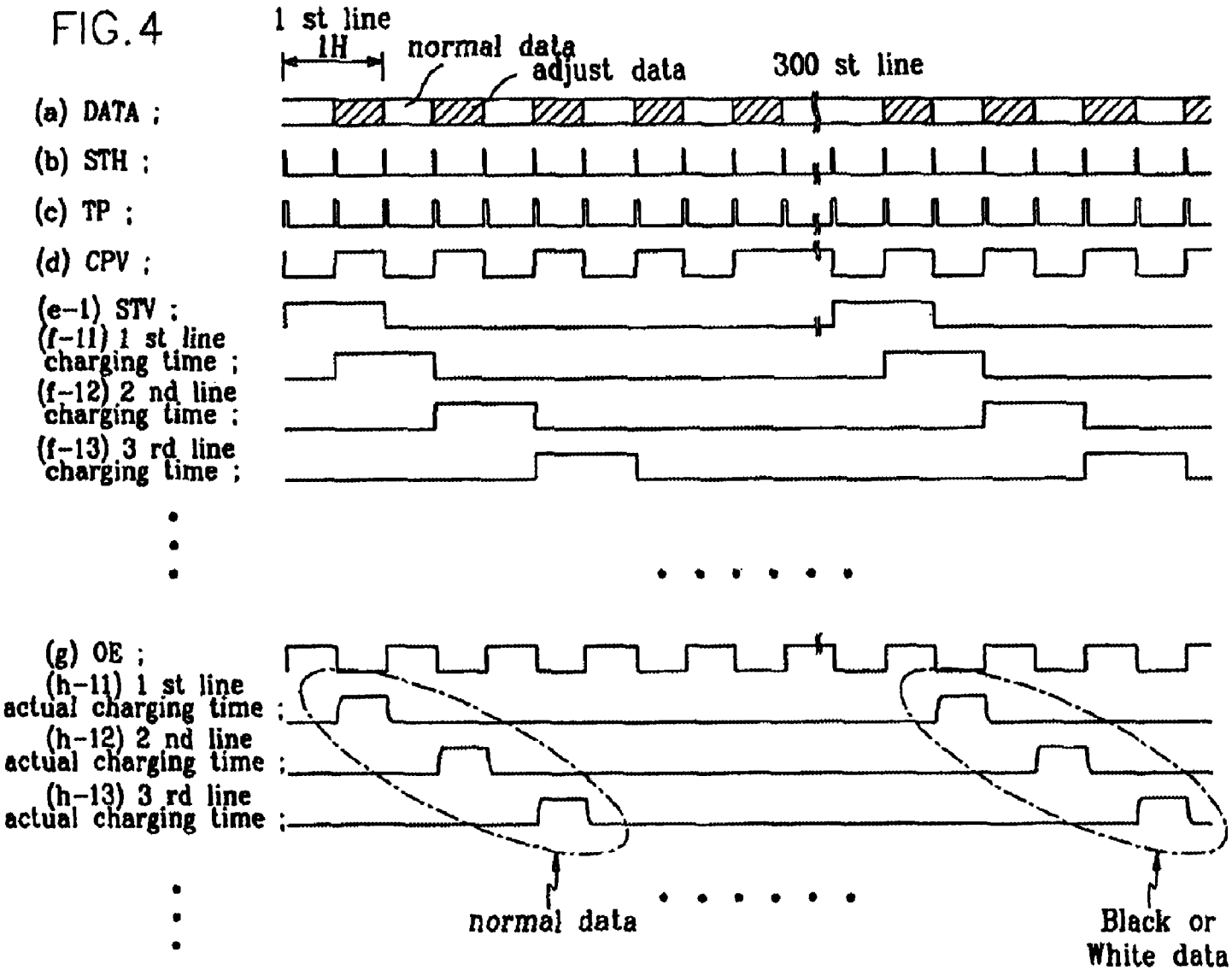
FIG. 4 shows control and data waveforms of a liquid crystal display according to one embodiment of the present invention.

FIG. 4 shows wave forms of the LCD according to a first embodiment of the present invention, and examples of voltages, which are charged on each gate line when normal data and adjust data (black or white data) are input for a 1 H period with an LCD panel of SVGA resolution (for example, 800×600).

Referring to FIG. 4, if outputting normal data and adjust data for a 1 H period, voltages (f-11, f-12, f-13, . . . ), charged on each gate line are charged for a 1 H period. According to this embodiment of the invention, voltages (h-11, h-12, h-13, . . . ) are actually charged on each gate line controlled by an output enable (OE) signal applied from the timing controller 100, and acts to offset the charge by normal data. As shown, normal data is charged in the first ½ H part of the period, and black or white adjust data is charged in the second ½ H part.

As described according to the first embodiment of the present invention, after normal data is input, and a predetermined amount of time has passed, black or white data is input to offset the charged voltage. According to the first embodiment of the present invention, the normal data of one frame is input to the LCD panel for ½ frame, thereby realizing impulse driving on the LCD.

Figure 5:
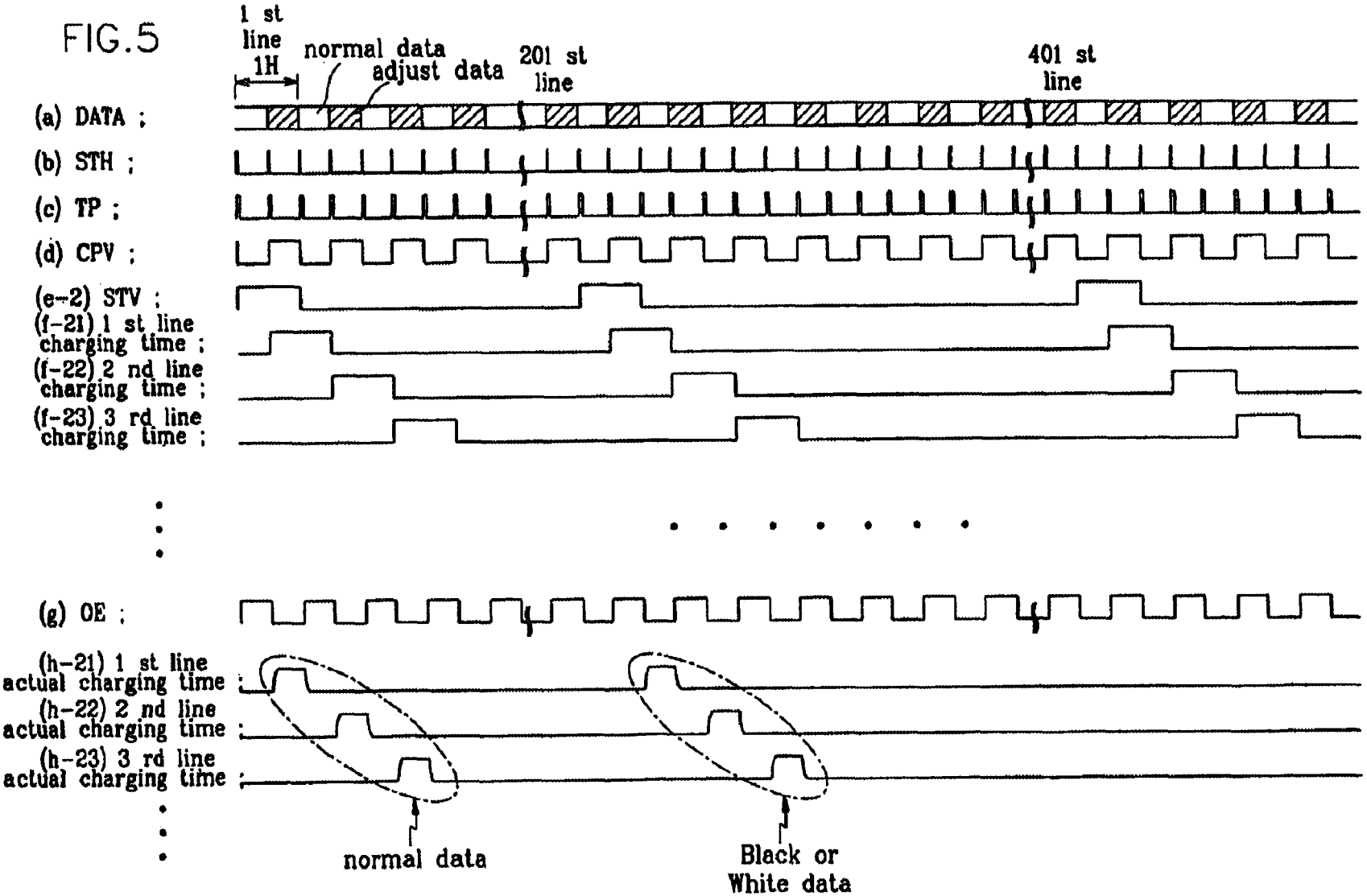
FIG. 5 shows control and data waveforms of a liquid crystal display according to another embodiment of the present invention.

FIG. 5 shows waveforms of the LCD according to a second embodiment of the present invention. The LCD panel 400 operates with SVGA resolution, for example, 800×600. If normal data and adjust data are output in a 1 H period, voltages (f-21, f-22, f-23, . . . ) are charged on each gate line for 1 H, but voltages (h-21, h-22, h-23, . . . ) actually charged on each gate line, controlled by an output enable (OE) signal applied from the timing controller, reduces charge time of normal data to the first ⅓ H part of the 1 H period, and black or white adjust data is charged in the middle ⅓ H part.

As described in the second embodiment of the present invention above, after normal data is input, and a predetermined time has passed, black or white data is input to offset charged voltage from normal data. According to the second embodiment of the present invention, it takes only ⅓ of a frame, that is, 5.33 ms, thereby realizing impulse driving on the LCD.

Figure 6A:
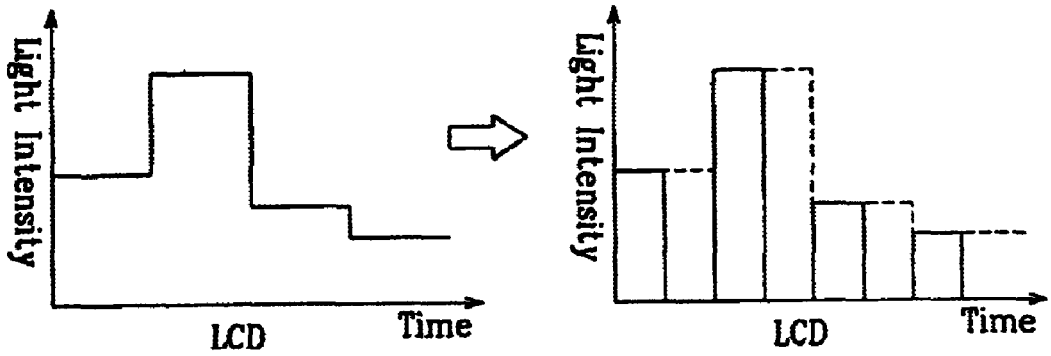
FIGS. 6*a* and 6*b* are graphical representation of waveforms of light density versus time of a conventional LCD and the LCD according to embodiments of FIGS. 4 and 5, respectively, of the present invention.
Figure 6B:
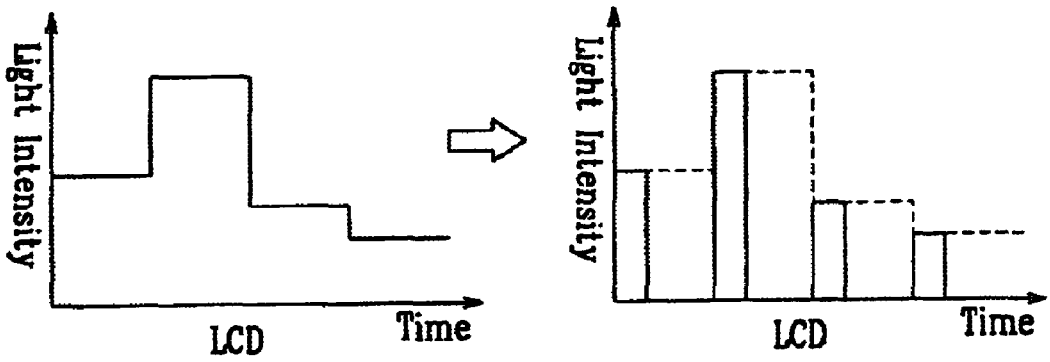

FIGS. 6*a* and 6*b* are graphical representation of wave forms of light density versus time of a conventional LCD and the LCD according to a first and a second embodiment of the present invention, respectively.

As shown in FIG. 6*a*, comparing graphs of light intensity versus time of the conventional LCD, and that of the LCD of the first embodiment of the present invention, an even level is maintained in every frame in the conventional LCD, but for an LCD of the first embodiment of the present invention, level intensity is maintained for a first predetermined time of each frame, but light intensity becomes 0 (zero) after the first predetermined time and maintains that level until the end of frame. In this case, one frame time is divided in half, and a certain level is maintained during the first part and a 0 (zero) level is maintained during the second part.

FIG. 6*b* shows the LCD of the second embodiment of the present invention controlled such that the time of one frame is divided into thirds, and a certain time of one frame, e.g. a first divided part of the frame, is maintained at a uniform level, and the rest of the frame, for example a second and a third divided part, is maintained at a 0 (zero) level.

Advantageously, according to the present invention, an impulse driven liquid crystal display for realizing moving images can be provided without a high-priced frame memory. Impulse driven LCD is accomplished using a line memory, which compared to the frame memory is less expensive.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A liquid crystal display (LCD) comprising:

an LCD panel including a plurality of switching devices and a plurality of liquid crystal capacitors;

an LCD drive controller for alternately outputting normal data representing image data and adjust data representing non-image data, and for outputting an output enable signal for selective application of the normal data and the adjust data to the switching devices; and a gate driver for outputting gate-on signals to the switching devices to be turned-on, pulse width of the gate-on signals being defined by the output enable signal, wherein the switching devices transmit the applied normal data or the adjust data to the liquid crystal capacitors and the liquid crystal capacitors periodically receive both the normal data and the adjust data.

2. The liquid crystal display of claim 1, wherein the adjust data is either black data or white data.

3. The liquid crystal display of claim 1, wherein the LCD drive controller outputs a start horizontal signal for controlling storage of the normal data or the adjust data, and a load signal for instructing to output the normal data or the adjust data.

4. The liquid crystal display of claim 1, wherein the LCD drive controller outputs a gate clock signal for controlling generation of the gate-on signals and a start vertical signal for controlling starting of the gate-on signals.

5. The liquid crystal display of claim 1, wherein the gate-on signals include a plurality of pairs of first and second gate-on signals alternately applied to the switching devices, the normal data are applied to the liquid crystal capacitors during the application of the first gate-on signals, the adjust data are applied to the liquid crystal capacitors during the application of the second gate-on signals, the first gate-on signals and the second gate-on signals are separately applied to each liquid crystal capacitor.

6. The liquid crystal display of claim 5, wherein the total duration of a pair of the first and second gate-on signals is 1H.

7. The liquid crystal display of claim 6, wherein the application time of the normal data is about one half of the 1H and the application time of the adjust data is about one half of the 1H.

8. The liquid crystal display of claim 5, wherein each second gate-on signal is simultaneously applied to a plurality of rows of the switching devices.

9. The liquid crystal display of claim 1, wherein the LCD drive controller includes a line memory for storing the normal data.

10. The liquid crystal display of claim 9, wherein the line memory comprises a first line memory for recording data, and a second line memory for outputting data.

* * * * *